US008899996B2

(12) United States Patent
Lim et al.

(10) Patent No.: US 8,899,996 B2
(45) Date of Patent: Dec. 2, 2014

(54) STACKED CONNECTOR

(75) Inventors: Kian Heng Lim, Singapore (SG); Yoke Wai Cheah, Singapore (SG)

(73) Assignee: Molex Incorporated, Lisle, IL (US)

( * ) Notice: Subject to any disclaimer, the term of this patent is extended or adjusted under 35 U.S.C. 154(b) by 50 days.

(21) Appl. No.: 13/641,343

(22) PCT Filed: Apr. 14, 2011

(86) PCT No.: PCT/US2011/032398

§ 371 (c)(1),
(2), (4) Date: Dec. 19, 2012

(87) PCT Pub. No.: WO2011/130465

PCT Pub. Date: Oct. 20, 2011

(65) Prior Publication Data

US 2013/0115815 A1 May 9, 2013

(30) Foreign Application Priority Data

Apr. 14, 2010 (SG) ..... 201002587
Apr. 14, 2010 (SG) ..... 201002588

(51) Int. Cl.

| | |
|---|---|
| ***H01R 12/00*** | (2006.01) |
| ***H01R 27/02*** | (2006.01) |
| ***H01R 13/6585*** | (2011.01) |
| ***H01R 13/652*** | (2006.01) |
| ***H01R 12/72*** | (2011.01) |
| *H01R 25/00* | (2006.01) |
| *H01R 107/00* | (2006.01) |

(52) U.S. Cl.

CPC ..... *H01R 13/652* (2013.01); *H01R 25/00* (2013.01); *H01R 27/02* (2013.01); *H01R 13/6585* (2013.01); *H01R 2107/00* (2013.01); *H01R 12/724* (2013.01)

USPC ..... 439/79; 439/607.05

(58) Field of Classification Search

CPC ..... H01R 23/7073; H01R 23/6873; H01R 23/688

USPC ..... 439/79, 92, 101, 108, 540.1, 541.5, 439/607.05, 607.09, 607.11, 607.31, 439/607.39, 607.4, 660

See application file for complete search history.

(56) References Cited

U.S. PATENT DOCUMENTS 6,540,559 B1 * 4/2003 Kemmick et al. ..... 439/607.05
7,650,695 B1 * 1/2010 Ju ..... 29/884

(Continued)

FOREIGN PATENT DOCUMENTS

JP H07-94244 A 4/1998
JP 2007-005316 A 1/2007

(Continued)

OTHER PUBLICATIONS

International Search Report for PCT/US2011/032398.

*Primary Examiner* — Thanh Tam Le
(74) *Attorney, Agent, or Firm* — Stephen L. Sheldon

(57) ABSTRACT

A stacked connector comprises a dielectric housing comprising a first receptacle and a second receptacle, a first set of differential pairs that each include a plurality of first terminals each having a contact portion extending within the first receptacle and an extension portion, a second set of differential pairs that each include a plurality of second terminals that each have a contact portion extending within the second receptacle and an extension portion, and a shield terminal including a plate portion and two contact portions separately extending within the first receptacle and the second receptacle. The plate portion can separate the extension portions of the terminals of one differential pair from the extension portions of another differential pair.

20 Claims, 13 Drawing Sheets

(56) References Cited

U.S. PATENT DOCUMENTS

| | | | | |
|---|---|---|---|---|
| 7,670,199 | B2 * | 3/2010 | Nagata et al. | 439/92 |
| 7,824,193 | B2 * | 11/2010 | Oyake et al. | 439/79 |
| 7,878,864 | B2 * | 2/2011 | Wang et al. | 439/668 |
| 7,931,481 | B2 * | 4/2011 | Yamakami | 439/79 |
| 7,955,094 | B2 * | 6/2011 | Lu | 439/79 |
| 7,988,487 | B2 * | 8/2011 | Nomiyama et al. | 439/541.5 |
| 8,100,724 | B2 * | 1/2012 | Lin et al. | 439/630 |
| 8,123,533 | B2 * | 2/2012 | Luo et al. | 439/79 |
| 2002/0042223 | A1 | 4/2002 | Belopolsky et al. | |
| 2003/0186594 | A1 | 10/2003 | Davis et al. | |
| 2009/0042448 | A1 | 2/2009 | He et al. | |

FOREIGN PATENT DOCUMENTS

| | | | |
|---|---|---|---|
| JP | 2009-043713 | A | 2/2009 |
| JP | 2009-043723 | A | 2/2009 |
| JP | 2010-027456 | A | 2/2010 |

* cited by examiner

STACKED CONNECTOR

RELATED APPLICATIONS

This application is a national phase of PCT Application No. PCT/US11/32398, filed Apr. 14, 2011, which in turn claims priority to Singapore Patent Application No. 201002588-0, filed Apr. 14, 2010 and to Singapore Patent Application No. 201002587-2, filed Apr. 14, 2010, all of which are incorporated herein by reference in their entirety.

BACKGROUND OF THE INVENTION

1. Field of the Invention

The present invention relates to the field of electrical connectors, more specifically to a stacked connector.

2. Description of the Related Art

Connectors are widely utilized as means to connect two devices for communication or data transmission. To meet the requirement of the transmission of large quantities of data, the rate of data transfer is continuously being increased. As the data rates increase, connectors designed for lower transmission speed may have to be redesigned to ensure signal integrity.

FIG. 1 shows a conventional stacked connector 1, and FIG. 2 shows a plurality of terminals 2 and 9 arrayed in the stacked connector 1. The stacked connector 1 includes a housing 11 having upper and lower receptacles 111 and 112 configured to separately hold the contact portions 21 and 91 of the terminals 2 and 9 juxtaposed along the housing 11. The plurality of upper and lower terminals 2 and 9 are densely arranged so that the space required by the stacked connector 1 can be small. Each of the plurality of upper and lower terminals 2 and 9 further includes a barbed portion 22 or 92 connected to the contact portion 21 or 91 and an extension portion 23 or 93 connected to the barbed portion 22 or 92. The extension portion 23 or 93 extends from the barbed portion 22 or 92, is bent vertically, and then extends straight to form an end that can be configured to be soldered to a through hole on a printed circuit board.

The plurality of upper terminals 2 partially received in the upper receptacle 111 may include two differential pairs 24 and 25, between which a ground pin 26, having a similar configuration to that of the terminal 2 of the differential pairs 24 and 25, is disposed. Similarly, the plurality of lower terminals 9 partially received in the lower receptacle 112 may include two differential pairs 94 and 95 and a ground pin 96 disposed between the two differential pairs 94 and 95. The terminals 2 of two differential pairs 24 and 25 received in the upper receptacle 111 have extension portions 23 longer than the extension portions 93 of the lower terminals 9 partially received in the lower receptacle 112. Accordingly, when the terminals 2 of the two differential pairs 24 and 25 are used at data rates of, for example 3 Gbps, signal integrity cannot be ensured due to their longer extension portions 23. In addition, the ground pin 26 or 96 having a configuration similar to the terminal 2 or 9 cannot provide sufficient shielding effectiveness, resulting in higher cross talk and reduced signal integrity. Further, the extension portion 23 or 93 of the terminal 2 or 9 is vertically bent, and such vertically bent terminals 2 may also affect the transmission of signals. Consequentially, certain individuals would appreciate an improved stacked connector.

SUMMARY OF THE INVENTION

The dielectric housing comprises a first receptacle and a second receptacle vertically spaced apart. A first set of differential pairs are provided in the first receptacle and a second set of differential pairs are provided in the second receptacle. Each terminal in the first set includes a contact portion, a retention portion, an extension portion, and a solder tail portion, wherein the contact portion of the first terminal extends within the first receptacle, the retention portion of the first terminal extends between the contact portion of the first terminal and the extension portion of the first terminal, and the extension portion of the first terminal extends between the retention portion of the first terminal and the solder tail portion of the first terminal Each terminal in the second set of differential pairs includes a contact portion, a retention portion, an extension portion, and a solder tail portion, wherein the contact portion of the second terminal extends within the second receptacle, the retention portion of the second terminal extends between the contact portion of the second terminal and the extension portion of the second terminal, and the extension portion of the second terminal extends between the retention portion of the second terminal and the solder tail portion of the second terminal. A shield terminal includes a plate portion and two contact portions. The two contact portions separately extend within the first receptacle and the second receptacle. The shield terminal is disposed between the two differential pairs of the first set of differential pairs and also is between two differential pairs of the second set of differential pairs. The plate portion is configured to separate the extension portions of the terminals so as to separate differential pairs of the first set of differential pairs and to also separate differential pairs of the second set of differential pairs.

BRIEF DESCRIPTION OF THE DRAWINGS

The invention will be described according to the appended drawings in which.

DETAILED DESCRIPTION OF THE INVENTION

Figure 1:
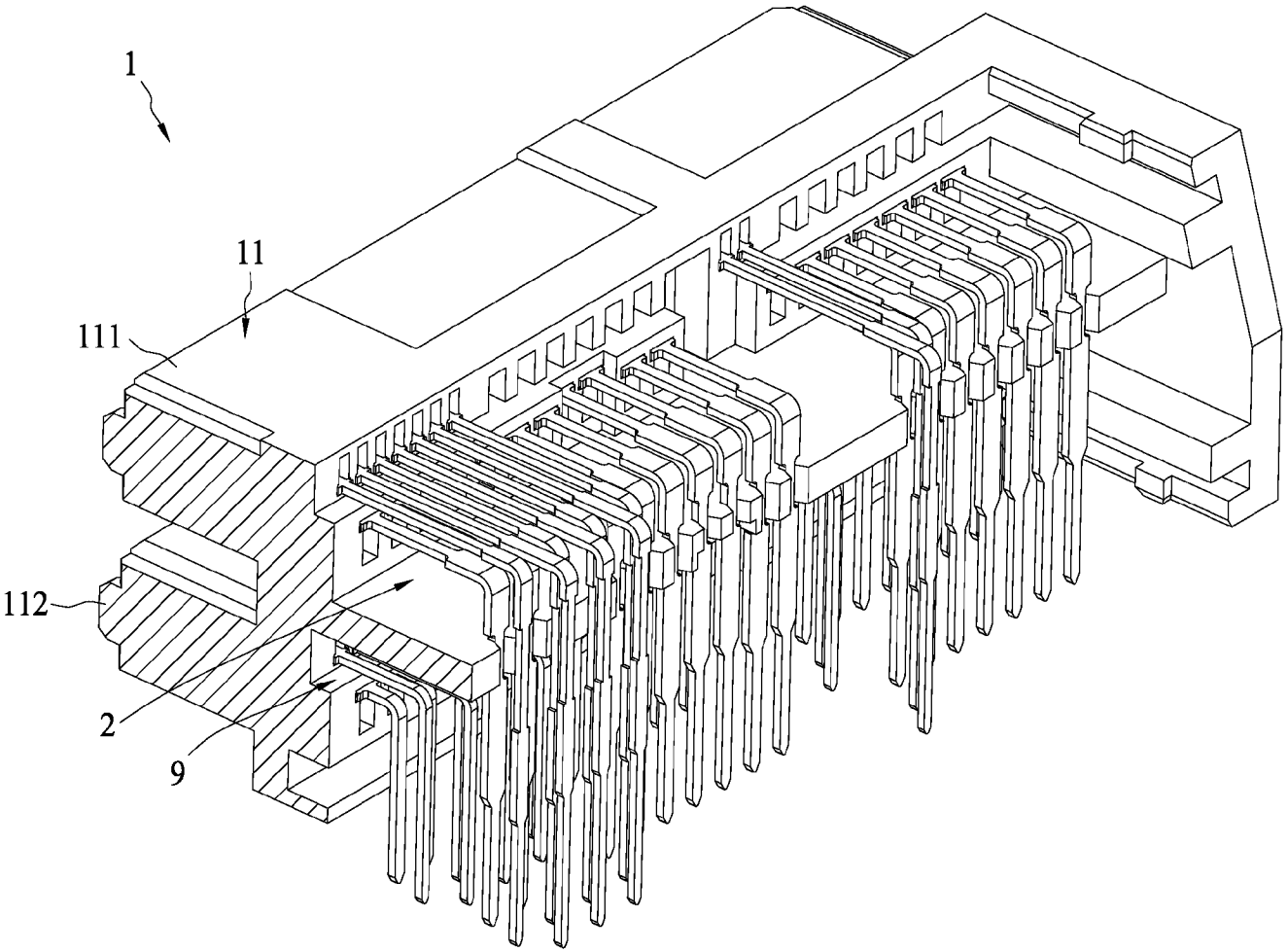
FIG. 1 (Prior Art)
FIG. 1 shows a conventional stacked connector.
Figure 2:
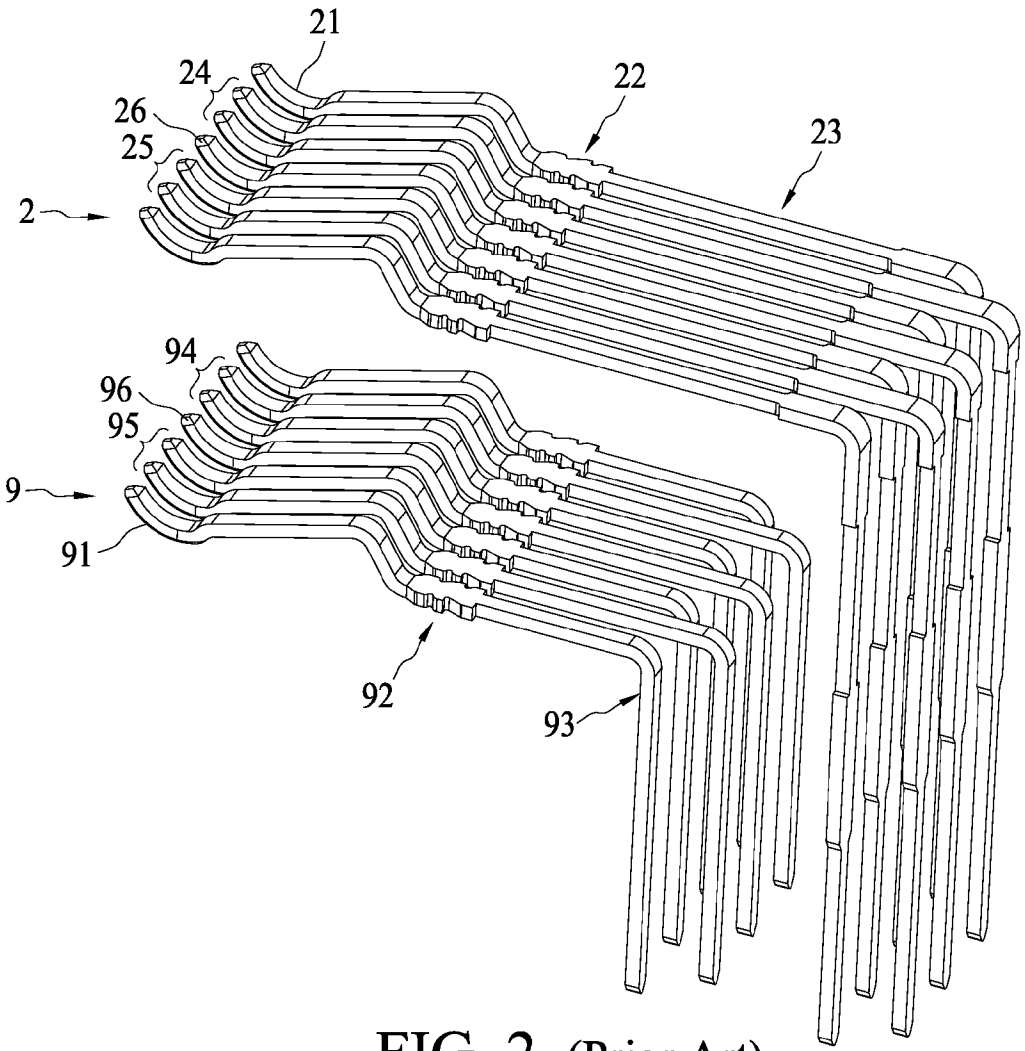
FIG. 2 (Prior Art)
FIG. 2 shows the plurality of terminals 2 arrayed in the stacked connector of FIG. 1.

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

One benefit of the depicted embodiments is that it is possible to provide a new and improved stacked connector that can be adapted for higher data rates. In order to achieve the above objective, one embodiment provides a stacked connector, which comprises a dielectric housing, two first differential pairs, two second differential pairs, and a shield terminal. As illustrated in FIGS. 3 to 6, for example, is a stacked connector 3. The stacked connector 3 comprises a dielectric housing 31 comprising a first receptacle 311 and a second receptacle 312, a shield terminal 32, a first set of differential pairs that includes differential pairs 4 and 5, and a second set of differential pairs that includes differential pairs 6 and 7.

Figure 3:
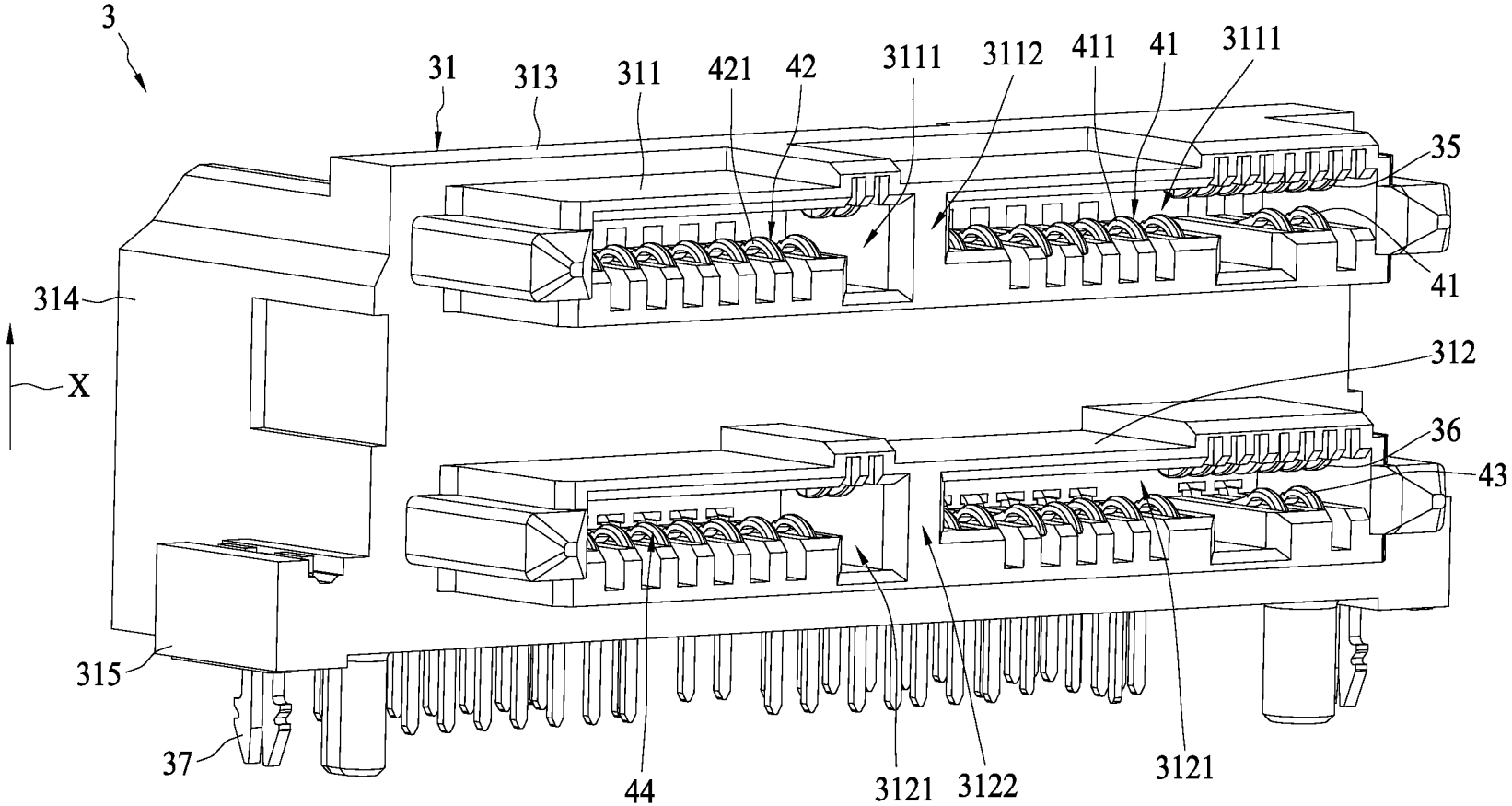
FIG. 3 illustrates a front perspective view showing an embodiment of a stacked connector.
Figure 4:
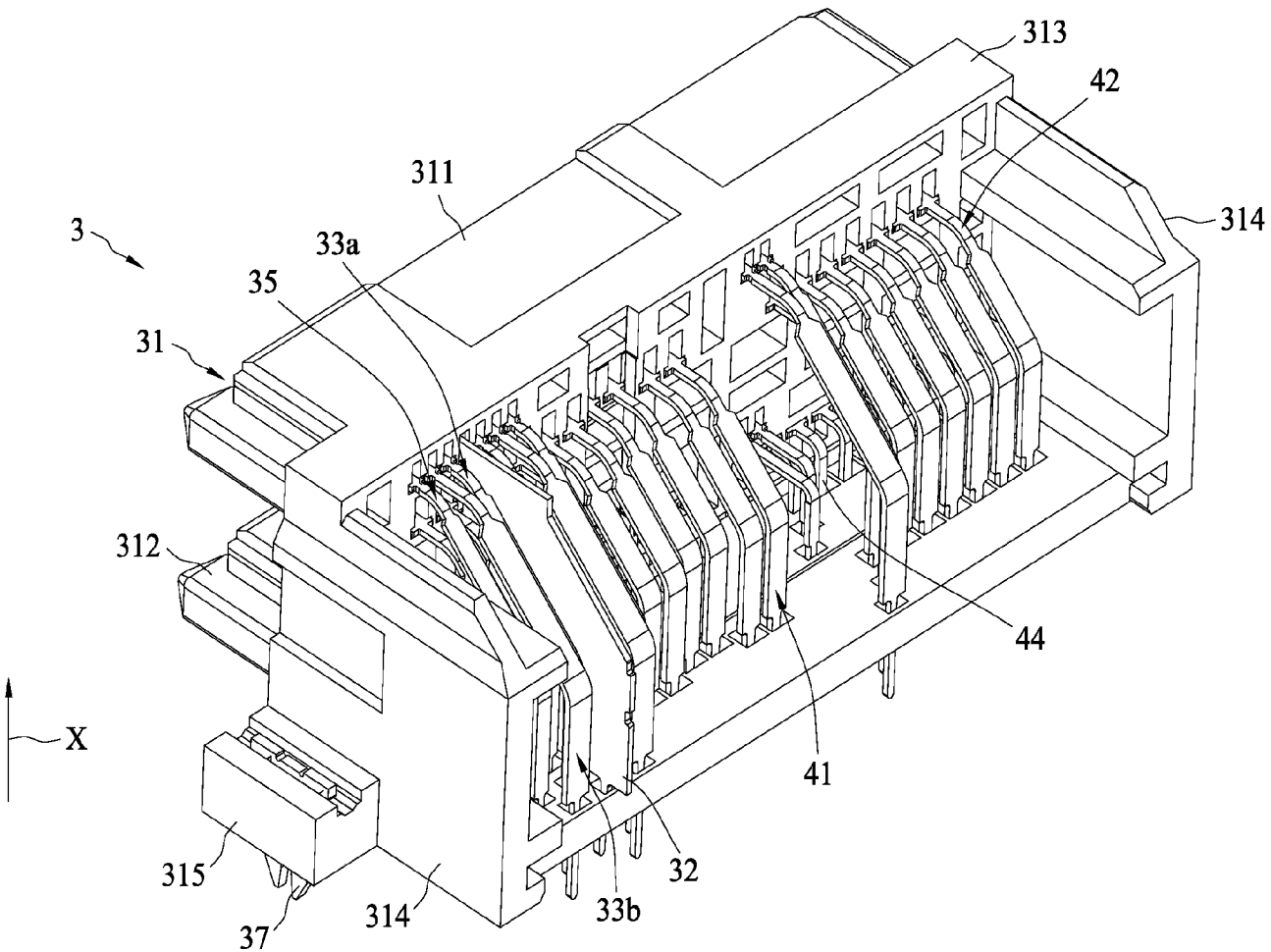
FIG. 4 illustrates a rear perspective view of the stacked connector of FIG. 3.
Figure 5:
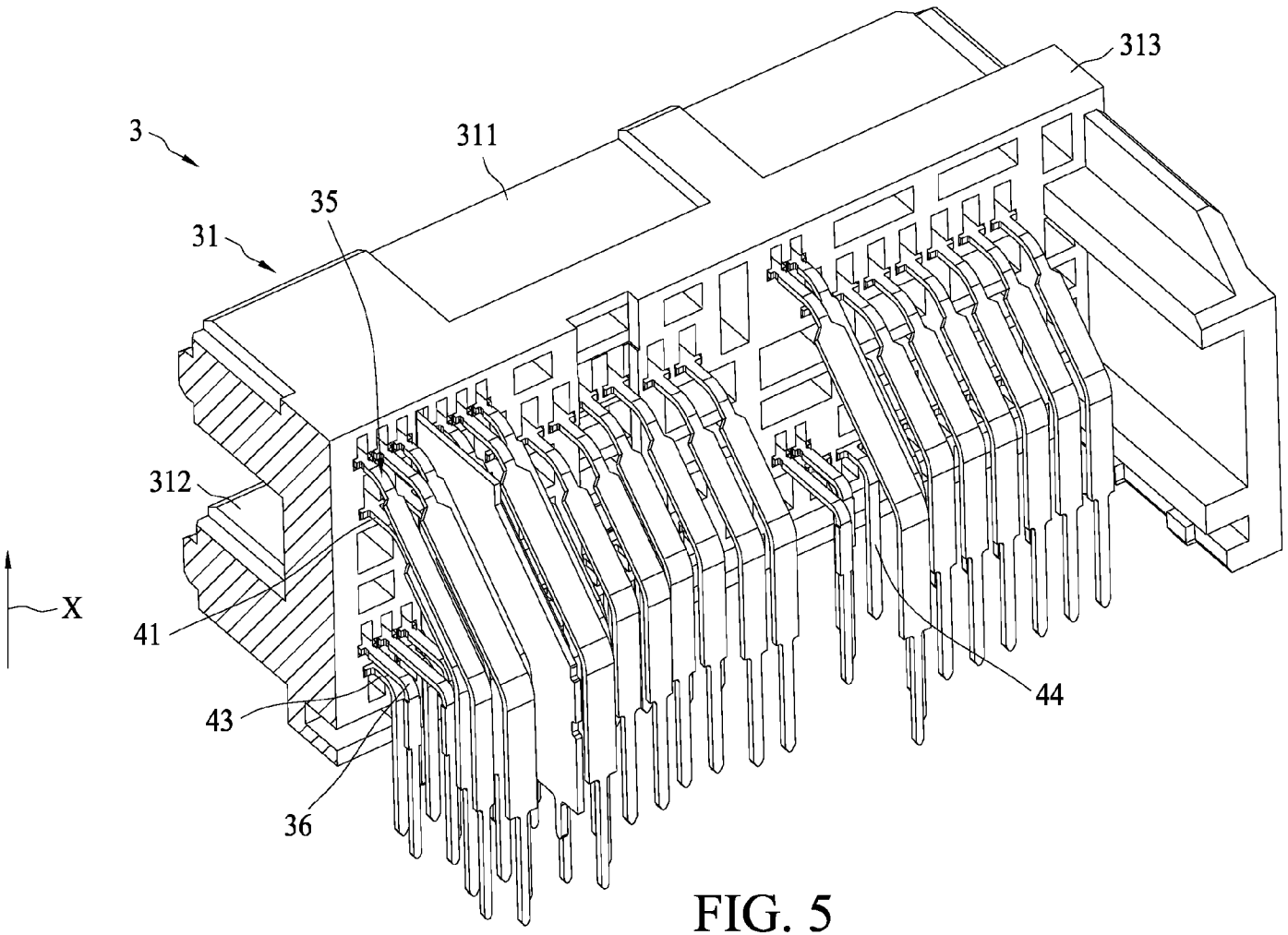
FIG. 5 illustrates a perspective, sectional view of the stacked connector of FIG. 4.

Referring to FIG. 3, the first receptacle 311 and the second receptacle 312, respectively protruding forward from a main body 313, are spaced apart in a vertical direction X. The first receptacle 311 may include a slot 3111 configured for receiving a mating plug connector. The slot 3111 can be a single slot extending within the first receptacle 311, or can be segmented by a partition 3112 as shown in FIG. 3. Similarly, the second receptacle 312 may also include an internally extending single slot 3121 for receiving a mating plug connector. The slots 3121 may also be segmented by a partition 3122 as shown in FIG. 3.

Figure 6:
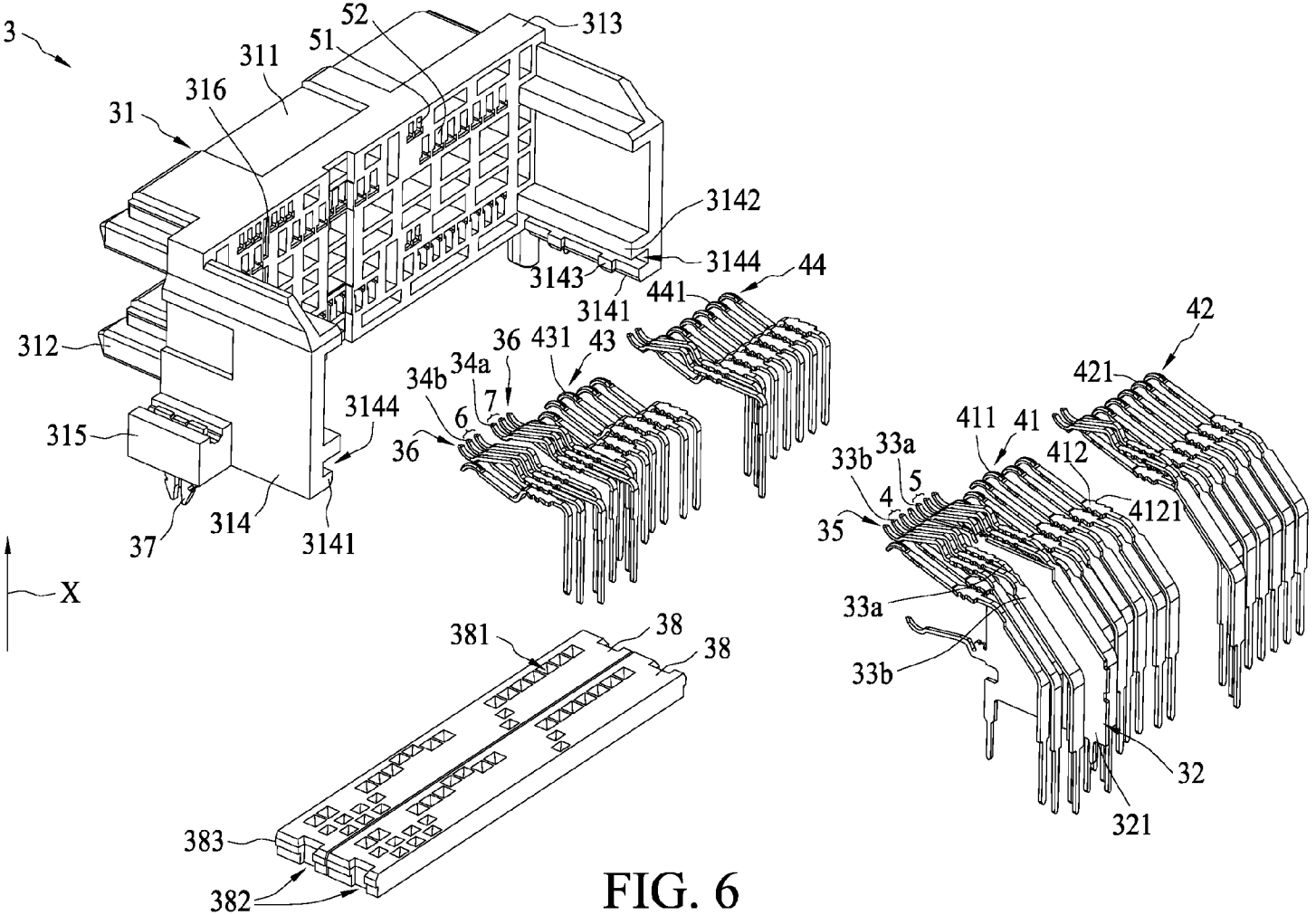
FIG. 6 illustrates an exploded perspective view showing an embodiment of a stacked connector.

Referring to FIGS. 3 and 6, the dielectric housing 31 may comprise two side walls 314 protruding backward from the main body 313, defining an accommodation space. On the external wall surface of each side wall 314, a fixing portion 315 can be disposed. The fixing portion 315 can be near the bottom edge of the respective side wall 314 and is configured to hold a board lock 37, by which the stacked connector 3 can be fixed to a printed circuit board.

Referring to FIG. 6, a lower protrusion 3141 can be disposed on the inner surface of each side wall 314, extending along the bottom edge of the side wall 314. Moreover, a middle protrusion 3142 can be disposed on the inner surface of each side wall 314, parallel to and separated from the lower protrusion 3141 by a gap 3144. The stacked connector 3 may further comprise two plate members 38, on which a plurality of through holes 381 are formed. On the two opposite side edges of each plate member 38, recesses 382 and projected portions 383 are formed. Correspondingly, on a side surface of each lower protrusion 3141 facing the accommodation space, two juts 3143 are formed to engage the respective recesses 382 so that the plate members 38 are guided while they are being assembled, and the plate members 38 can be constrained after they are assembled. The projected portion 383 extends widthwise and is disposed adjacent to the top surface of the plate member 38. In addition, the projected portion 383 is configured to interfere with the lower protrusion 3141 and to be received by the respective gap 3144, and to be held between the middle protrusion 3142 and the lower protrusion 3141 after the plate member 38 is installed.

Referring to FIGS. 6, 7, 11, and 13, each of the first set of differential pairs 4 and 5 may comprise a first terminal 33*a* and a second terminal 33*b* used for differential signaling. Each of the first and second terminals 33*a* and 33*b* may comprise a contact portion 331 configured to extend above the slot 3111 and partially protrude into the slot 3111, a retention portion 332, an extension portion 333*a* or 333*b*, and a solder tail portion 334 configured to extend through the respective through hole 381 in the plate members 38. The retention portion 332 is configured to extend between the contact portion 331 and the extension portion 333*a* or 333*b*, and the extension portion 333*a* or 333*b* is configured to extend between the retention portion 332 and the solder tail portion 334. Each of the second set of differential pairs 6 and 7 may comprise a third terminal 34*a* and a fourth terminal 34*b* used for differential signaling. Each of the third and fourth terminals 34*a* and 34*b* may comprise a contact portion 341 configured to extend above the slot 3121 and partially protrude into the slot 3121, a retention portion 342, an extension portion 343*a* or 343*b*, and a solder tail portion 344 configured to extend through the respective through hole 381 in the plate members 38. The retention portion 342 is configured to extend between the contact portion 341 and the extension portion 343*a* or 343*b*, and the extension portion 343*a* or 343*b* is configured to extend between the retention portion 342 and the solder tail portion 344.

Figure 10:
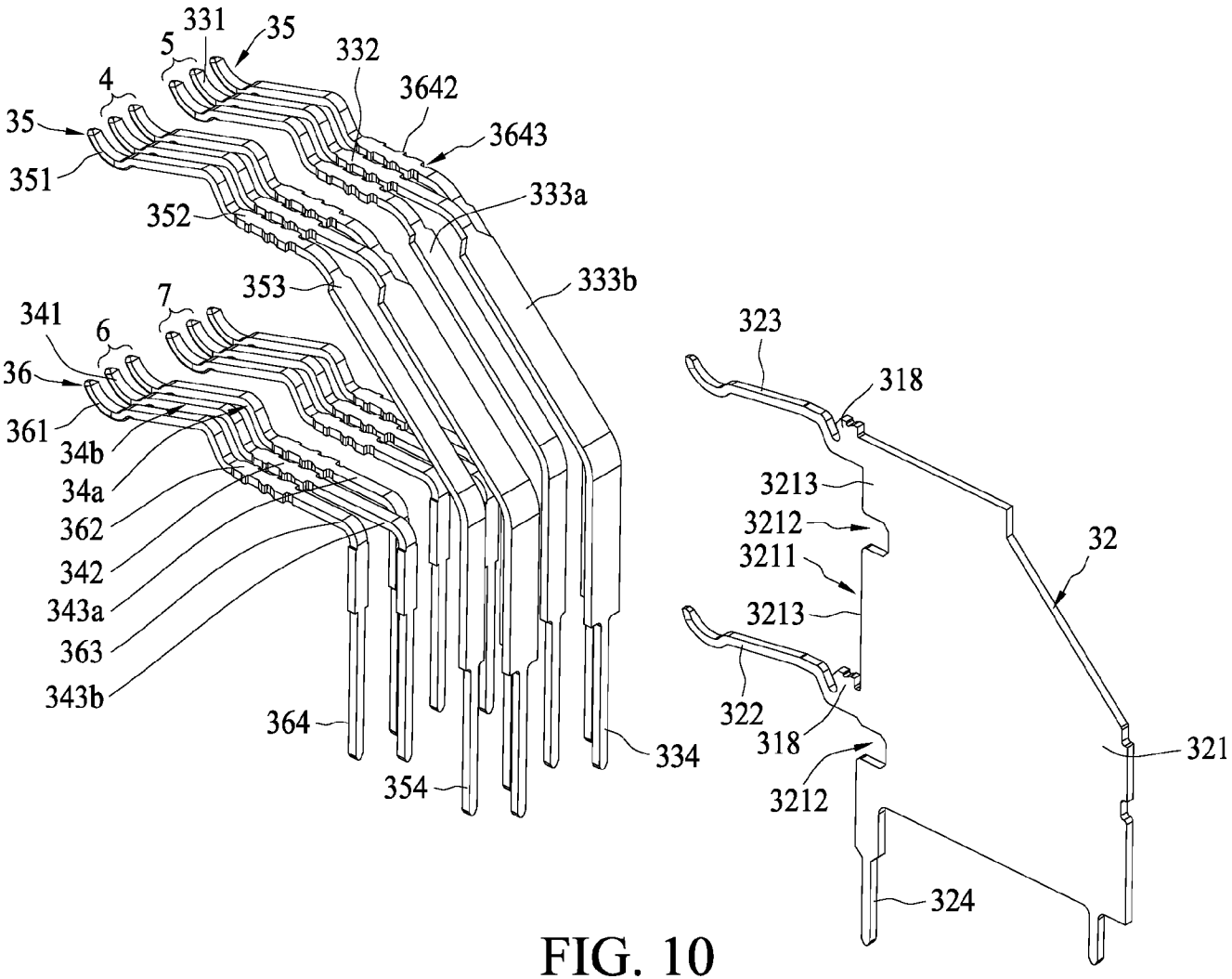
FIG. 10 illustrates an exploded perspective view of the terminals depicted in FIG. 7.
Figure 11:
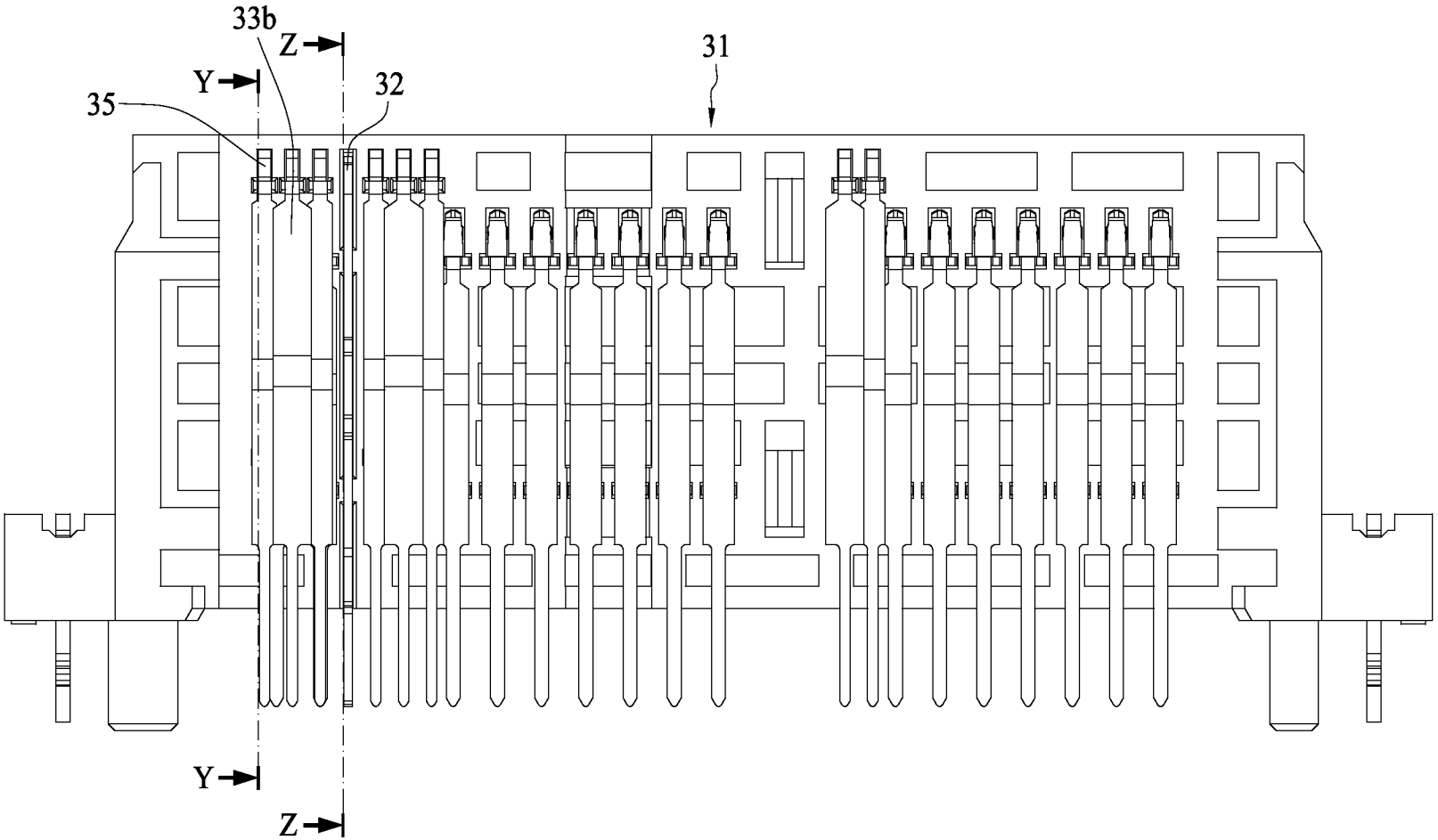
FIG. 11 illustrates an elevated rear view of an embodiment of a stacked connector.
Figure 12:
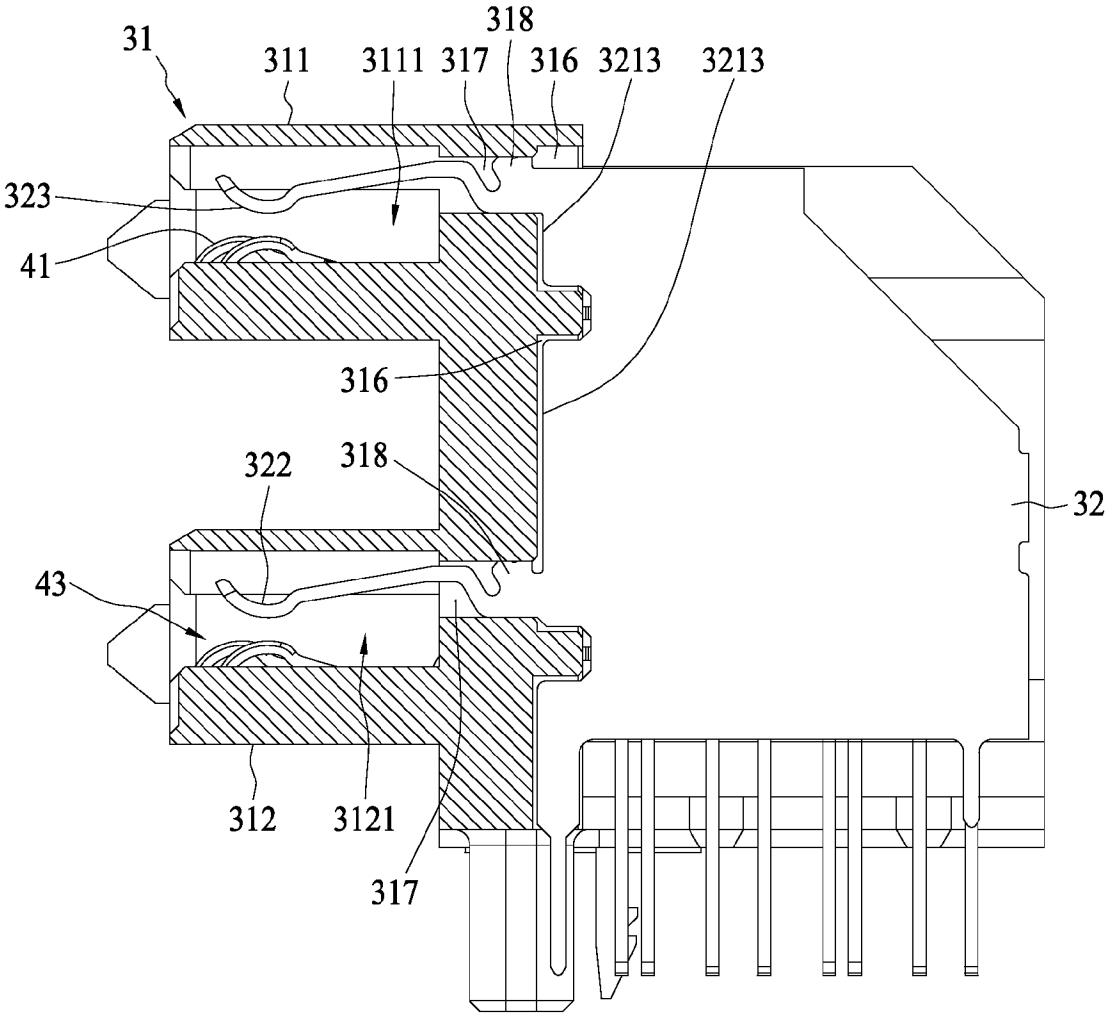
FIG. 12 illustrates a cross-sectional view taken along line Z-Z of FIG. 10.
Figure 13:
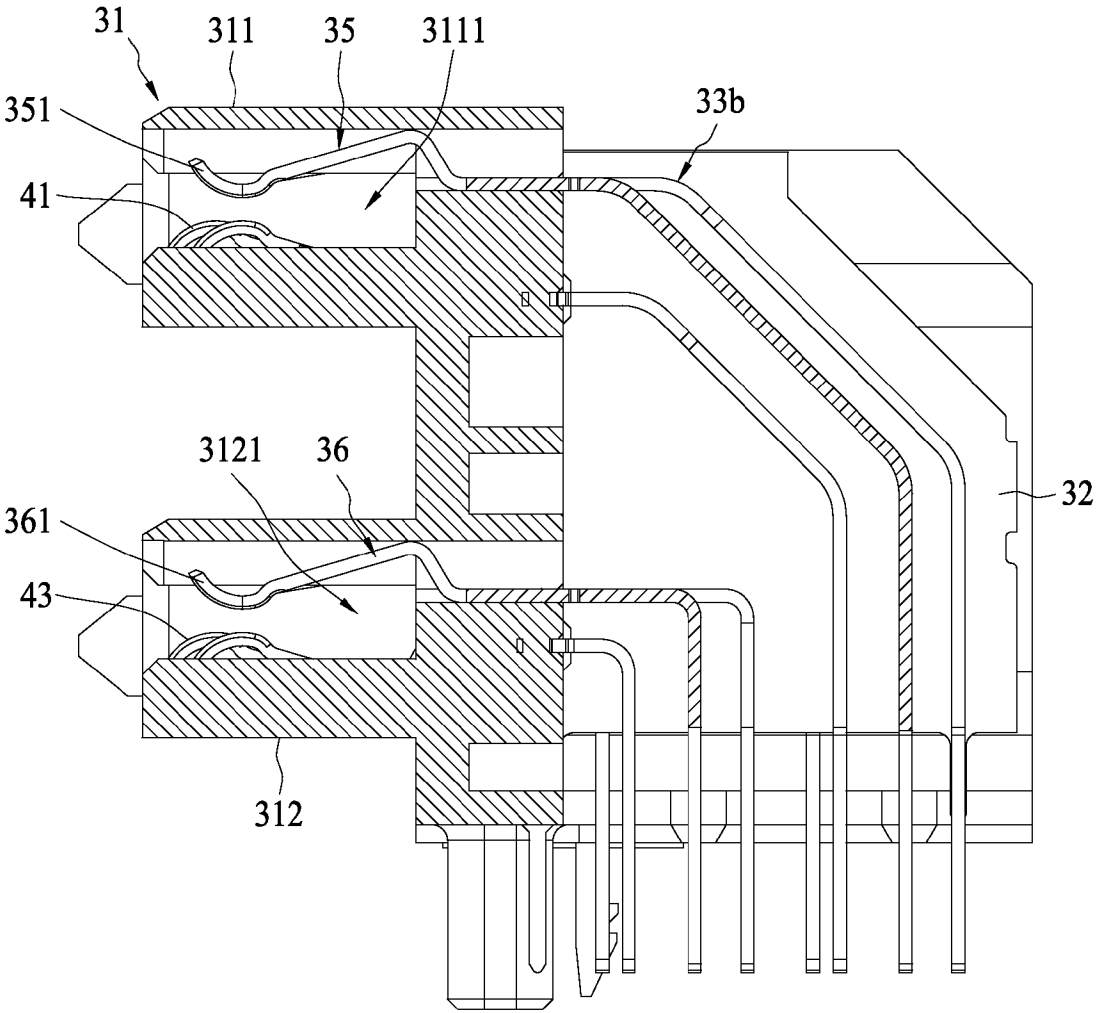
FIG. 13 illustrates a cross-sectional view taken along line Y-Y of FIG. 10.

Referring to FIG. 10, the shield terminal 32 may include a plate portion 321 having a first side edge 3211 and disposed within the accommodation space, a lower contact portion 322 protruding forward from the first side edge 3211, an upper contact portion 323 protruding forward from the first side edge 3211, and a solder tail portion 324 protruding downward from the plate portion 321 and configured for being soldered to a ground connection point of a printed circuit board. Referring to FIGS. 10 and 12, the lower contact portion 322 is configured to extend within the second receptacle 312, above the slot 3121, with a part of the lower contact portion 322 protruding into the slot 3121 for electrically engaging a mated connector. The upper contact portion 323 is configured to extend within the first receptacle 311, above the slot 3111, with a part of the upper contact portion 323 protruding into the slot 3111 for electrically engaging a mated connector. As shown in FIG. 10, a plurality of notches 3212 can be formed on the first side edge 3211 of the plate portion 321 so as to divide the first side edge 3211 into several segments 3213. Correspondingly, a plurality of slits 316, as shown in FIG. 6, can be formed for receiving the segments 3213. Thus, the shield terminal 32 can be properly held after it is installed.

As shown in FIG. 12, two holes 317 can be separately formed to communicate the slot 3111 with the respective slit 316 and to communicate the slot 3121 with the respective slit 316, respectively allowing the lower and upper contact portions 322 and 323 to be inserted into the slots 3111 and 3121. Two barb portions 318 can be separately formed between the plate portion 321 and the lower contact portion 322, and between the plate portion 321 and the upper contact portion 323. The barb portions 318 are configured to engage the respective holes 317 so as to secure the shield terminal 32 to the dielectric housing 31.

Figure 7:
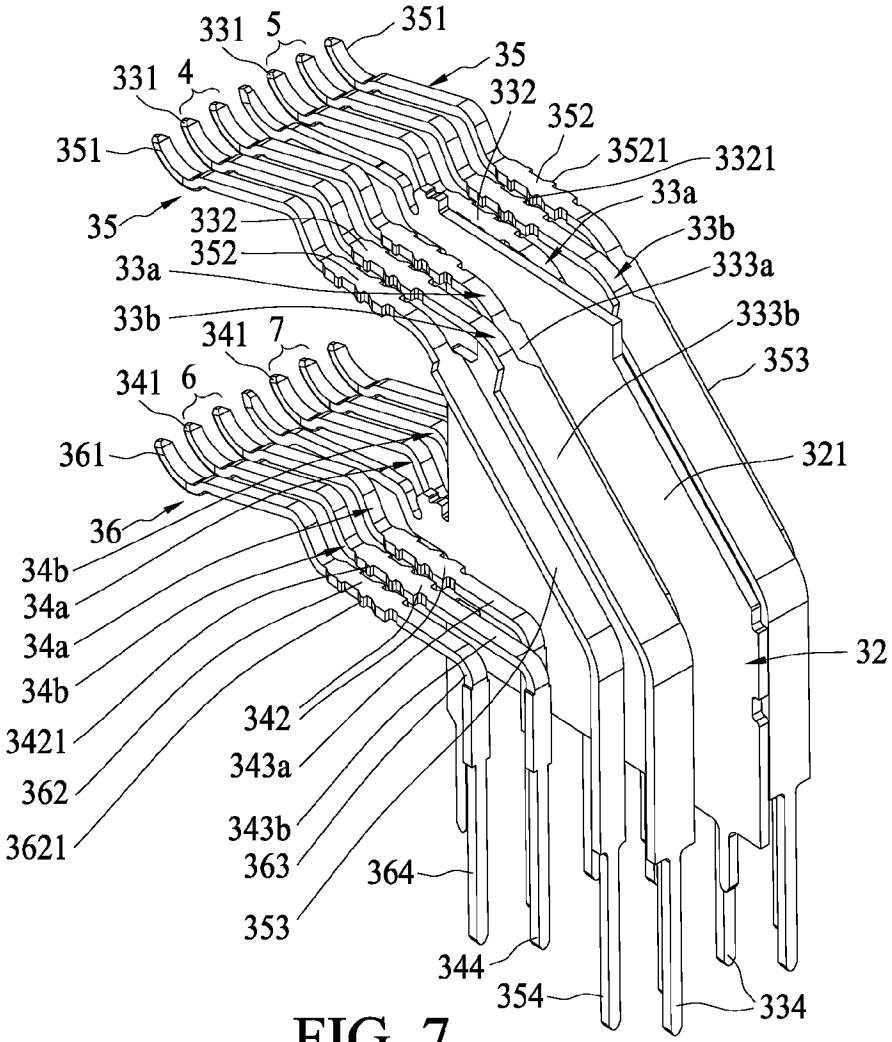
FIG. 7 illustrates a perspective view of an embodiment of a plurality of differential pairs of terminals and a shield terminal.
Figure 8:
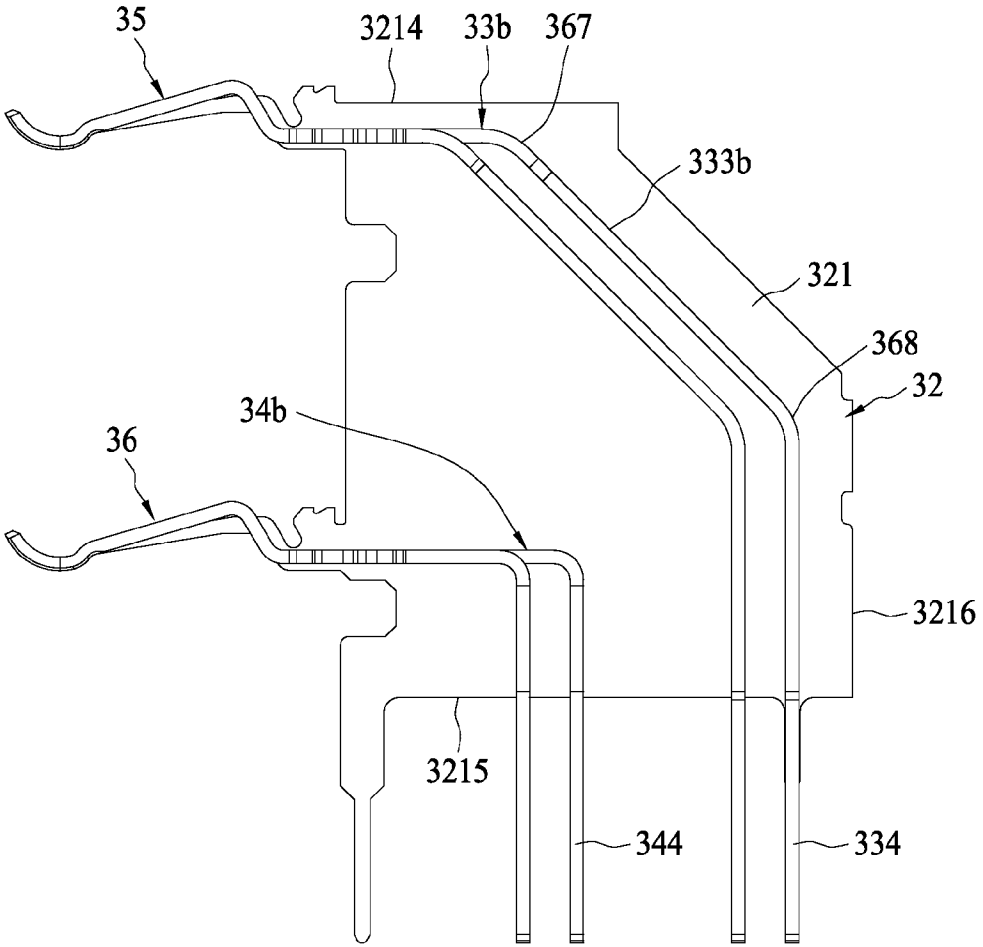
FIG. 8 illustrates an elevated side view of the terminals depicted in FIG. 7.

Referring to FIGS. 7, 8, 9, 11, and 13, the shield terminal 32 can be grounded and is configured to be disposed between the two first differential pairs 4 and 5 and between the second differential pairs 6 and 7, as shown in FIG. 7. Referring to FIGS. 7 and 8, the plate portion 321 of the shield terminal 32 is configured to separate or hide the extension portions 333*a* and 333*b* of the first and second terminals 33*a* and 33*b* of the differential pair 4 from the extension portions 333*a* and 333*b* of the first and second terminals 33*a* and 33*b* of the differential pair 5 such that the coupling and crosstalk between the two differential pairs 4 and 5 can be reduced and the signal transmission data rate can be increased. Furthermore, the plate portion 321 of the shield terminal 32 is also configured to separate or hide the extension portions 343*a* and 343*b* of the third and fourth terminals 34*a* and 34*b* of the differential pair 6 from the extension portions 343*a* and 343*b* of the third and fourth terminals 34*a* and 34*b* of the differential pair 7 such that the coupling and crosstalk between the differential pairs 6 and 7 can be reduced and the signal transmission data rate can be increased. Specifically, the plate portion 321 includes an upper edge 3214 configured to be higher than the higher end portions of the extension portions 333*a* and 333*b* connecting to the respective retention portions 332, a lower edge 3215 configured to be lower than the lower end portions of the extension portions 343*a* and 343*b* connecting to the respective retention portions 342, and a second side edge 3216 correspondingly configured to be away from the dielectric housing 31 farther than the extension portions 333*a* and 333*b* of the first terminals 33*a* and 33*b*.

Referring to FIGS. 6 to 9, the stacked connector 3 may further comprise two first ground terminals 35 each disposed adjacent to one of the differential pairs 4 and 5 and opposite to the shield terminal 32, and two second ground terminals 36 each disposed adjacent to one of the differential pairs 6 and 7 and opposite to the shield terminal 32. Each first ground terminal 35 may comprise a contact portion 351 configured to partially protrude into the slot 3111, a retention portion 352, an extension portion 353, and a solder tail portion 354 configured to extend through the respective through hole 381 in the plate members 38. The retention portion 352 is configured to extend between the contact portion 351 and the extension portion 353, and the extension portion 353 is configured to extend between the retention portion 352 and the solder tail portion 354. Correspondingly, each second ground terminal 36 may comprise a contact portion 361 configured to partially protrude into the slot 3121, a retention portion 362, an extension portion 363, and a solder tail portion 364 configured to extend through the respective through hole 381 in the plate members 38. The retention portion 362 is configured to extend between the contact portion 361 and the extension portion 363, and the extension portion 363 is configured to extend between the retention portion 362 and the solder tail portion 364.

Figure 9:
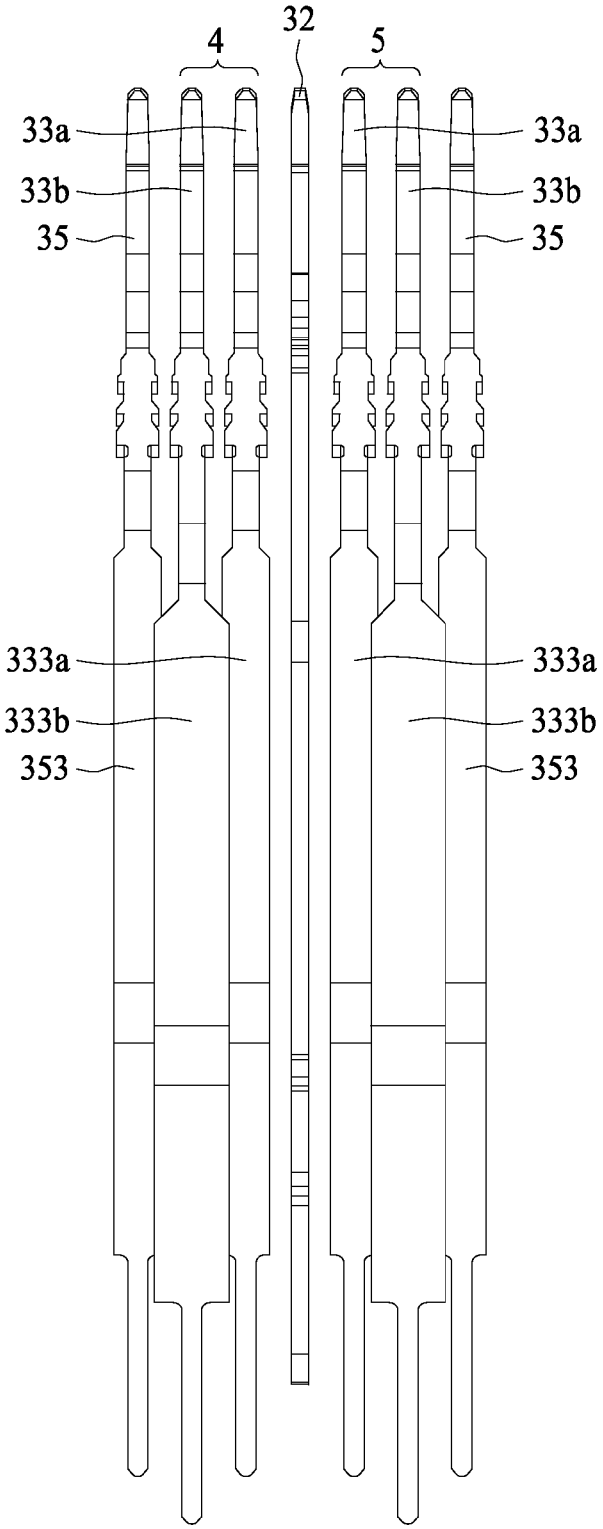
FIG. 9 illustrates a partial elevated rear view of the terminals depicted in FIG. 7.

Referring to FIGS. 7 to 9, the first and second terminals 33*a* and 33*b* of each of the differential pairs 4 and 5 and the ground terminal 35 disposed adjacent thereto may be juxtaposed, and the extension portions 333*a*, 333*b* and 353 of the first terminals 33*a* and 33*b* and the ground terminal 35 may be arranged in a manner that can facilitate coupling of signals. To help with the differential coupling, the widened sections of the first terminals 33*a* and 33*b* of the differential pairs 4 and 5 may differently spaced from the dielectric housing 31, and the widened section of the terminal 33*b* next to the respective first ground terminal 35 has a width greater than a spaced distance between the respective first ground terminal 35 and the terminal 33*a*. Specifically, the widened section of the extension portion 333*b* of the first terminal 33*b* is disposed away from the dielectric housing 31 farther than the widened sections of the extension portions 333*a* and 353 of the first terminals 33*a* and the ground terminal 35, and the widened section of the extension portion 333*b* of the first terminal 33*b* may further have a width greater than the spaced distance between the widened sections of the extension portion 333*a* of the first terminal 33*a* and the extension portion 353 of the ground terminal 35, as shown in FIG. 9. Thus, the edge portions of the widened sections of the extension portion 333*b* can overlap both the edge portion of the widened section of the extension portion 333*a* and the edge of widened section of the extension portion 353, resulting in better coupling of signals.

As can be appreciated, therefore, the differential pairs 4 and 5 thus comprises the terminal 33*a* with the extension portion 333*a* that is less wide then the extension portion 333*b* of the terminal 33*b*. Furthermore, while the terminals are positioned side-by-side in the contact portion, they are transitioned to a offset relationship in the extension portion so that the wider extension portion 333*b* of the terminal 33*b* can overlap over both the extension portion of 333*a* of the terminal 33*a* (which is the other terminal of the differential pair 4,5 and also overlap the extension portion 353 of the ground terminal 35. This can provide improved control over the coupling between the differential terminals and the associated ground terminal so as to provide a better managed data channel. As can be further appreciated, the orientation of the differential pair (including the ground terminal) on opposite sides of the shield terminal can be reversed (e.g., the orientation of the two differential pair can be a mirror image of each other).

Referring to FIGS. 7 and 8, each of the extension portions 333*a*, 333*b*, and 353 of the first terminals 33*a* and 33*b* and the ground terminals 35 may include two obtuse bends 367 and 368 such that the contact portion 331 of each first terminals (33*a* or 33*b*) and the corresponding solder tail portion 334 of the first terminal (33*a* or 33*b*) can extend in different directions, and the contact portion 351 of the first ground terminal 35 and the solder tail portion 354 of the first ground terminal 35 can extend in different directions. In addition, due to the application of the obtuse bends 367 and 368, the terminals 33*a* and 33*b* and the ground terminals 35 do not have to be sharply bent; therefore, signal transmission can be improved. In the present embodiment, the angle of the two obtuse bends 367 and 368 can be, for example but without limitation, 135 degrees.

Referring to FIGS. 6 and 7, a plurality of arrayed terminal holes 51 and 52 can be formed through the main body 313 of the dielectric housing 31 and can be communicated to the respective slots 3111 and 3121. The retention portion 332, 342, 352 or 362 of each of the terminals 33*a* and 33*b*, the terminals 34*a* and 34*b*, and the ground terminals 35 and 36 may include a plurality of oppositely protruding barbs 3321, 3421, 3521 or 3621 configured for secure engagement with two opposite side walls defining the respective terminal hole 51 or 52. In addition, the contact portions 331, 341, 351 and 361 of the terminals 33*a* and 33*b*, the terminals 34*a* and 34*b*, and the ground terminals 35 and 36 are inserted into the respective receptacles 311 and 312 through the terminal holes 51 and 52 such that each terminal hole 51 or 52 is configured to be widened vertically so as to allow the respective contact portion 331, 341, 351 or 361 to pass through and to enter into the respective receptacle 311 or 312.

In addition, the barbs 3321 of the first terminals 33 can be aligned in a direction parallel to the array direction of the first terminals 33 such that the signal integrity of the signals transmitted on the first terminals 33 can be ensured. Similarly, the barbs 3421 of the second terminals 34 can be aligned in a direction parallel to the array direction of the second terminals 34 such that the signal integrity of the signals transmitted on the second terminals 34 can be ensured.

Referring to FIGS. 3 and 6, the stacked connector 3 may further comprise a plurality of first power terminals 41 each including a contact portion 411 extending below and partially protruding into the slot 3111 within the first receptacle, a plurality of first signal terminals 42 each including a contact portion 421 extending below and partially protruding into the slot 3111 within the first receptacle, a plurality of second power terminals 43 each including a contact portion 431 extending below and partially protruding into the slot 3121 within the second receptacle, and a plurality of second signal terminals 44 each including a contact portion 441 extending below and partially protruding into the slot 3121 within the second receptacle.

As can be appreciated, therefore, a stacked connector can include a shield terminal having a plate portion configured to separate the differential pairs of a first set of differential pairs and to also separate the differential pairs of a second set of differential pairs so that the coupling and crosstalk between the differential pairs of the first set and the second set can be reduced and the signal transmission data rate of the differential pairs can be increased. Terminal of the differential pairs may include two obtuse bends rather than a single right angle bend, resulting in improved signal transmission.

The above-described embodiments are intended to be illustrative only. Numerous alternative embodiments may be devised by persons skilled in the art without departing from the scope of the following claims.

What is claimed is:

1. A connector, comprising:

a dielectric housing, the housing including a first receptacle and a second receptacle vertically spaced apart;

a first set of differential pairs that each include a plurality of first terminals, the plurality of first terminals each having a first contact portion, a first retention portion, a first extension portion, and a first solder tail portion, wherein the first contact portion extends within the first receptacle and the first retention portion extends between the first contact portion and the first extension portion and the first extension portion extends between the first retention portion and the first solder tail portion;

a second set of differential pairs that each include a plurality of second terminals, each of the plurality of second terminals having a second contact portion, a second retention portion, a second extension portion, and a second solder tail portion, wherein the second contact portion extends within the second receptacle, the second retention portion extends between the second contact portion and the second extension portion and the second extension portion extends between the second retention portion and the second solder tail; and a shield terminal including a plate portion and two contact portions, the plate portion and two contact portions being integrally formed, the two contact portions separately extending within the first receptacle and the second receptacle, the plate portion of the shield terminal disposed between the first set of differential pairs and between the second set of differential pairs, wherein the plate portion is configured to separate the first extension portion of one of the plurality of first terminals from the first extension portion of another of the plurality of first terminals and to also separate the second extension portion of one of the plurality of second terminals from the second extension portion of another of the plurality of second terminals.

2. The connector of claim 1, wherein the shield terminal further comprises at least an integrally formed solder tail portion configured for grounding.

3. The connector of claim 2, further comprising two first ground terminals and two second ground terminals, wherein one of the first ground terminals is disposed adjacent to one differential pair of the first set of differential pairs and the other of the first ground terminals is disposed adjacent to another differential pair of the first set of differential pairs and wherein one of the second ground terminals is disposed adjacent to one differential pair of the second set of differential pairs and the other of the second ground terminals is disposed adjacent to another differential pair of the second set of differential pairs, the two first ground terminals being on opposite sides of the shield terminal and the two second ground terminals being on opposite sides of the shield terminal.

4. The connector of claim 3, wherein each of the first ground terminals includes a first ground extension portion and each of the extension portions of the first terminals and the first ground extension portions of first ground terminals comprises a widened section.

5. The connector of claim 4, wherein the widened sections of the first terminals of first set of differential pairs are spaced differently from the dielectric housing and wherein the widened section of the one of the first terminals that is next to the respective first ground terminal has a width that is greater than a distance between the respective first ground terminal and the other first terminal.

6. The connector of claim 5, wherein each of the first extension portions of the first terminal and the first ground terminal comprises two obtuse bends.

7. The connector of claim 6, wherein the retention portion of each of the first terminal and the second terminal comprises a plurality of barbs, the barbs of the plurality of first terminals are aligned in a direction parallel to an array direction of the plurality of first terminals, and the barbs of the plurality of second terminals are aligned in a direction parallel to an array direction of the plurality of second terminals.

8. The connector of claim 3, further comprises a plurality of first power terminals each including a contact portion extending within the first receptacle, a plurality of first signal terminals each including a contact portion extending within the first receptacle, a plurality of second power terminals each including a contact portion extending within the second receptacle, and a plurality of second signal terminals each including a contact portion extending within the second receptacle.

9. The connector of claim 8, wherein the dielectric housing comprises two side walls, wherein the shield terminal is disposed between the two side walls.

10. The connector of claim 9, further comprising a plurality of plate members each having oppositely disposed projected portions, and each side wall comprises a lower protrusion and a middle protrusion separated from the lower protrusion, wherein each projected portion is configured to interfere with the respective lower protrusion and to be held between the respective lower protrusion and the middle protrusion.

11. An electrical connector, comprising:

a dielectric housing configured for connecting to a mated connector;

a first differential pair including two first terminals that each include a first contact portion, a first retention portion, a first extension portion, and a first solder tail portion, one of the two first terminals being on a first side of the differential pair, wherein the first contact portion extends within the dielectric housing, the first retention portion extends between the first contact portion and the first extension portion, and the first extension portion extends between the first retention portion and the first solder tail portion;

a ground terminal juxtaposed to the first differential pair, the ground terminal including a ground contact portion, a ground retention portion, a ground extension portion, and a ground solder tail portion, wherein the ground contact portion extends within the dielectric housing, the ground retention portion extends between the ground contact portion and the ground extension portion and the ground extension portion extends between the ground retention portion and the ground solder tail portion, wherein the extension portions of the two first terminals and the ground terminal are arranged in a staggered manner; and a middle terminal that is positioned adjacent the terminal on the first side, the middle terminal including a middle extension portion that includes a widened section that partially overlaps the extension portions of the terminal on the first side and the ground terminal.

12. The electrical connector of claim 11, wherein a second differential pair is juxtaposed to the first differential pair, the second differential pair including two first terminals, wherein the ground terminal is a first ground terminal and the electrical connector further includes a second ground terminal, the second ground terminal juxtaposed to the second differential pair, the middle terminal being disposed between the first and second differential pairs, and the first and second ground terminals being respectively disposed on the same sides of the first and second differential pairs.

13. The electrical connector of claim 12, wherein the first extension portion and the ground extension portion comprise two obtuse bends.

14. The electrical connector of claim 13, wherein the dielectric housing comprises a first receptacle and a second receptacle vertically spaced, wherein the contact portions of the first terminals and the first ground terminals extend within the first receptacle.

15. The electrical connector of claim 14, further comprising two additional differential pairs and two additional ground terminals, each additional differential pair including two second terminals, each of the two second terminals having a second contact portion, a second retention portion, a second extension portion, and a second solder tail portion, wherein the second contact portion extends within the second receptacle, wherein the second retention portion extends between the second contact portion and the second extension portion, and the second extension portion extends between the second retention portion and the second solder tail portion, wherein the two additional differential pairs are disposed adjacent the two additional ground terminals.

16. The electrical connector of claim 15, wherein the middle terminal includes a plate portion and two contact portions, the plate portion and two contact portions being integrally formed, one of the two contact portions extending within the first receptacle and the other of the two contact portions extending within the second receptacle, the plate portion being disposed between the first differential pair and the second differential pair and between the two additional differential pairs, the plate portion configured to separate the extension portions of the first terminals of the first differential pair from extension portions of the first terminals of the second differential pair, and to separate the extension portions of the second terminals of one additional differential pair from the extension portions of the second terminals of the other additional differential pair.

17. The electrical connector of claim 16, wherein the middle terminal further comprises at least one integrally formed solder tail portion.

18. The electrical connector of claim 17, wherein the retention portion of each of the first terminals and the second terminals comprises a plurality of barbs, the barbs of the first terminals are aligned in a direction parallel to an array direction of the first terminals, and the barbs of the second terminals are aligned in a direction parallel to an array direction of the second terminals.

19. The electrical connector of claim 15, further comprising a plurality of first power terminals that each include a contact portion extending within the first receptacle, a plurality of first signal terminals that each include a contact portion extending within the first receptacle, a plurality of second power terminals that each include a contact portion extending within the second receptacle, and a plurality of second signal terminals that each include a contact portion extending within the second receptacle.

20. The electrical connector of claim 19, wherein the dielectric housing comprises two side walls, wherein the middle terminal is disposed between the two side walls.

* * * * *